United States Patent [19]

Pelletier

[11] Patent Number: 5,067,263

[45] Date of Patent: Nov. 26, 1991

[54] VARIABLE GEOMETRY TILLER

[75] Inventor: Michel Pelletier, Rockforest, Canada

[73] Assignee: Bombardier Inc., Canada

[21] Appl. No.: 612,463

[22] Filed: Nov. 14, 1990

[30] Foreign Application Priority Data

Jan. 22, 1990 [CA] Canada ..... 2008235

[51] Int. Cl.[5] ..... E01C 19/22

[52] U.S. Cl. ..... 37/220; 37/219; 37/197

[58] Field of Search ..... 37/219, 220, 221, 222, 37/223, 224, 232, 197; 405/115

[56] References Cited

U.S. PATENT DOCUMENTS

| | | | |
|---|---|---|---|
| 4,651,450 | 3/1987 | York et al. | 37/219 X |
| 4,651,451 | 3/1987 | Beeley et al. | 37/219 |
| 4,718,183 | 1/1988 | Haug | 37/221 |
| 4,726,129 | 2/1988 | Haug | 37/222 |
| 4,775,014 | 10/1988 | Ranner | 37/222 X |
| 4,888,891 | 12/1989 | Haug | 37/222 |
| 4,897,941 | 2/1990 | Sinykin | 37/22 X |

FOREIGN PATENT DOCUMENTS

| | | | |
|---|---|---|---|
| 26108 | 2/1983 | Japan | 405/115 |

*Primary Examiner*—Dennis L. Taylor
*Assistant Examiner*—J. Russell McBee
*Attorney, Agent, or Firm*—Larson and Taylor

[57] ABSTRACT

In the realm of snow grooming devices for ski hills, a unique snow tiller is disclosed. The snow tiller is pulled by a tracked vehicle and has a snow chamber which can be varied in size and dimension. The tiller is also equipped with a cutting drum which works the snow for a longer period of time when the snow chamber is enlarged. By varying the angle of the trailing bar mounted on a flexible membrane, which forms the outer bounds of the snow chamber, more or less snow is retained in the chamber depending upon snow conditions.

16 Claims, 6 Drawing Sheets

VARIABLE GEOMETRY TILLER

FIELD OF INVENTION

This invention relates to snow grooming devices for ski hills and, more particularly, the invention is directed to snow tillers.

BACKGROUND OF THE INVENTION

At today's ski resorts, with increased skier traffic, snow making and snow grooming has become an essential part of any successful ski centre. Tracked vehicles are usually the power source and these are equipped with a number of attachments or devices to help in the snow grooming process Generally, a tracked vehicle has an inverted V-shaped plow on the front which collects snow from areas where there is too much and moves it to areas which are worn The tracked vehicle generally has a tiller attached to the rear. The tiller consists of a drum with a number of cutting projection on it. The drum with the cutting projections rotates within a housing and breaks up ice chunks or other undesirable types of snow.

The tiller is usually equipped with a snow chamber immediately behind the revolving drum which collects the snow so that it can be worked by the drum. At the rear of the tiller is a flexible mat equipped with a number of grooved finishing elements The finishing elements smooth out the snow into a reasonable skiing surface.

In the present art the tillers have a rigid housing or cover over the snow chamber. The cover is located between the flexible finishing membrane and the cutting drum housing.

It has been found, however, that because of differing snow conditions, present day tillers suffer serious disadvantages. For example, when the snow is extremely icy it is maintained and worked in the snow chamber for the same amount of time as when the snow is particularly soft. As a result, the finished surface which is left once the tiller passes over is not consistent.

It is therefore an object of the present invention to provide an improved tiller wherein the length of time that the snow is worked and retained in the snow chamber can be varied according to snow conditions.

It is also an object of the present invention to provide a device which is inexpensive and easy to make whereby the snow chamber can be enlarged or reduced quickly and effortlessly by the operator of the power source as conditions change across any given ski slope on any given day.

SUMMARY OF THE INVENTION

Therefore this invention seeks to provide a snow tiller device adapted to be pulled by a power source comprising: a snow chamber located to the rear of a horizontally disposed cutting drum and parallel thereto; said snow chamber being bounded on the top by a flexible membrane, and being open at the front and bottom; wherein said snow chamber is adapted to be varied in size and dimension by a power means, according to snow conditions.

In a preferred embodiment of the invention, the cover for the snow chamber is made with a flexible membrane, for example, reinforced rubber mat or some other type of long wearing material. Between the finishing portion of the mat and the cutting drum is a flexible, semi-rigid bar which, when in operation, is transverse to the direction of the power source. On top of the flexible bar are mounted a couple of support brackets. These brackets are comprised of a top horizontal beam with a leg at each end. The legs are fixedly attached to the semi-rigid bar.

The brackets are pivotally connected to a main structural member of the tiller and pivotally attached to a hydraulic cylinder and piston.

When cylinders are activated and the pistons extended, the bar is tilted rearwardly. The mat-type flexible membrane under the bar is also tilted rearwardly. This puts more pressure on the snow immediately in front of the bar. This action retains the snow longer in the snow chamber. As more snow collects within the chamber, the flexible membrane is deformed upwardly and the snow is retained in the chamber for a longer period of time. The drum is constantly rotating and working the snow within the snow chamber.

If the snow is soft and in good quantity, it is not necessary to work the snow for a significant length of time. Therefore, the operator retracts the pistons causing the trailing bar to regain its normal substantially horizontal position. When the trailing bar is retracted back to its normal substantially horizontal position, the snow easily slides thereunder thereby allowing the snow chamber to take its normal smaller dimensions.

In the preferred embodiment of the invention, the tiller is equipped with the known devices such as a rotating cutting drum with projections. The rotating cutting drum can be raised or lowered into the snow depending upon the conditions. A hydraulic cylinder and piston activated by the operator accomplishes this task. In particularly wet snow conditions or extremely thick ice, it is necessary to raise the rotating drum in order that it does not bog down in the snow.

The tiller is also equipped with a couple of vertically disposed snow shields which are located above the cutting drum housing. These prevent snow blown up by the groomer from blowing over the tiller and not being worked sufficiently.

The trailing finishing portion of the membrane is equipped with known finishing elements which are secured to the underside of the trailing mat in two or more rows. These elements are generally about a foot in length and can be comprised of steel or fibreglass. The trailing mat or finishing membrane as it is sometimes called has a certain amount of flexibility in order to closely follow the contour of the snow. The trailing bar is semi-rigid and has a certain amount of flexibility such that the trailing bar and that portion of the flexible membrane thereunder, will also follow the contour of the snow surface.

It is to be understood that the invention described herein can be varied in a number of ways and is not restricted to the particular embodiment to be described hereinafter, but includes any embodiment wherein the dimensions and size ofthe snow chamber can be varied.

BRIEF DESCRIPTION OF THE DRAWINGS

The invention will be described in greater detail in conjunction with the following drawings wherein.

DETAILED DESCRIPTION OF THE INVENTION

Figure 1:
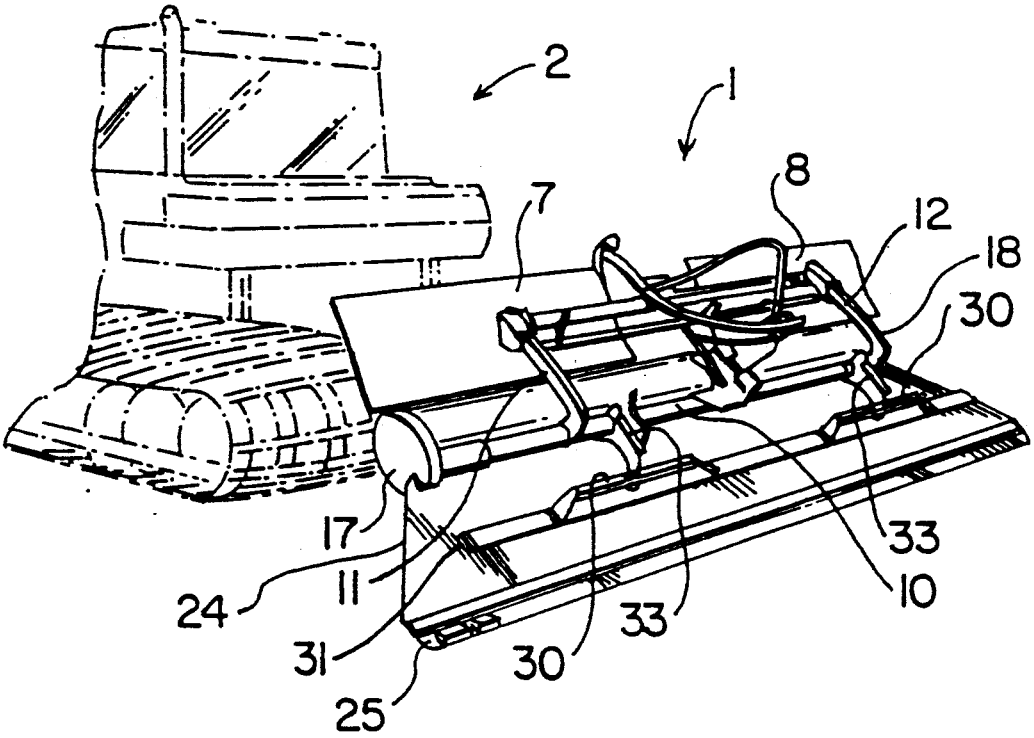
FIG. 1 is a perspective view of the invention attached to a power source which is a groomer.
Figure 2:
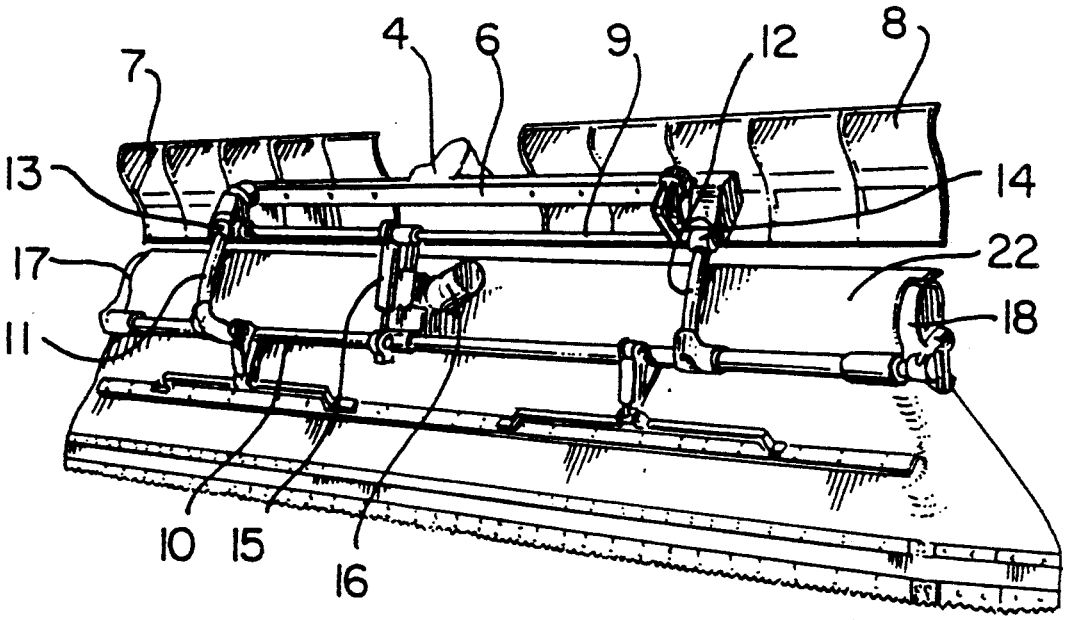
FIG. 2 is a face view of the rear of the invention.

In FIG. 1 a snow tiller (1) is attached to a power source (2) which is suitably a ski hill tracked groomer. The ski hill tracked groomer is equipped with a large ball (3) on the rear thereof which is adapted to fit within a ball hitch (4) as shown in FIG. 2.

Ball hitch (4) is attached to the rear lift frame (5) of the tiller. The rear lift frame (5) is fixedly attached to the upper main frame (6). Fixedly attached to the upper main frame (6) are left upper snow guard (7) and right upper snow guard (8). The snow guards prevent the snow which is raised from the tracks of the power source (2) from rising over the tiller. Pivotally attached to the upper main frame (6) is a structural horizontally placed angulating rod (9).

The horizontal main structural beam (10) lies below the structural angling bar (9) and is connected therewith by left structural support member (11) and right structural support member (12). The left and right structural support members (11) and (12) are fixedly attached to the horizontal main structural beam (10), but pivotally attached to the structural angular rod (9) at pivot points (13) and (14). Movement of the horizontal main structural beam (10) is accomplished by a hydraulic piston and cylinder (15). That cylinder could also be mounted on the ball lift frame mechanism, instead of being mounted on the tiller.

Figure 5:
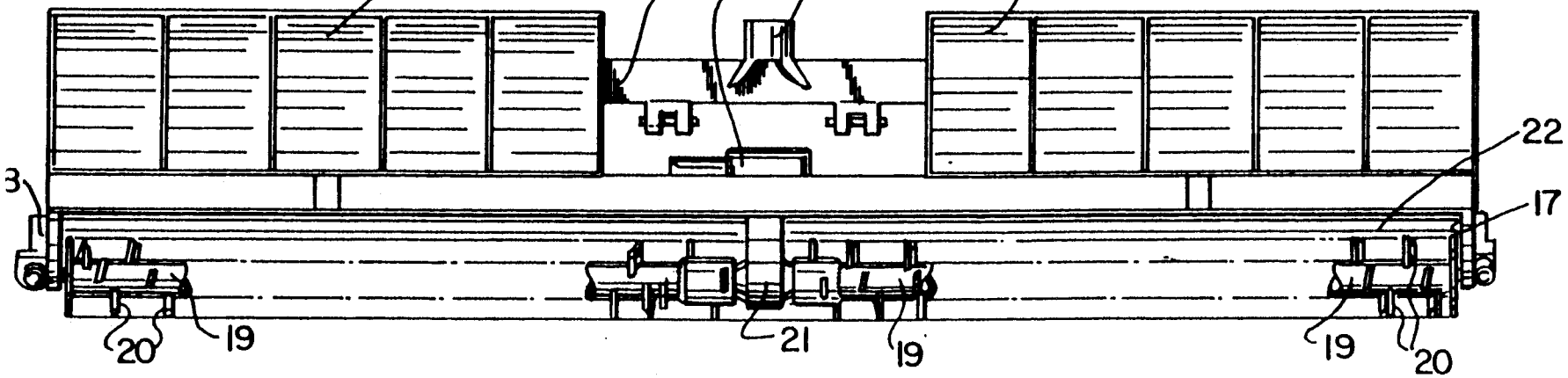
FIG. 5 is a view of the underside of the invention.
Figure 6:
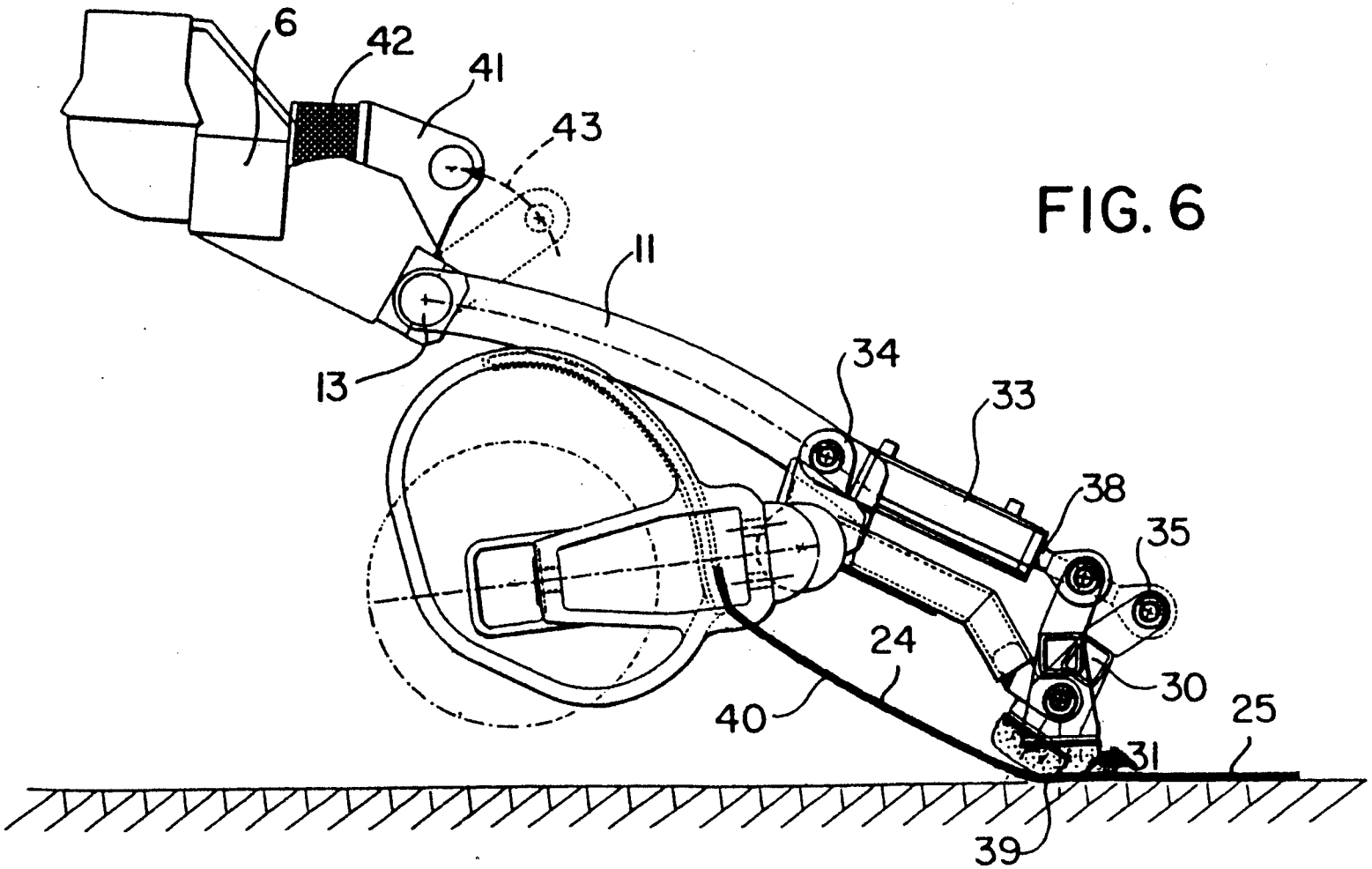
FIG. 6 is an end view of the invention.

The partial displacement of the main structural member (10) is used to change the angle between the left and right structural members (11) and (12) and the upper main frame (6) thereby permitting a cutting drum (19) as shown in FIG. 5 to be raised or lowered. Hydraulic motor (16) is used to rotate the cutting drum. The horizontal cutting drum (19) is supported within a housing having a left drum housing end (17) and a right drum housing end (18). The drum housing ends are fixedly attached to the horizontal main structural beam (10).

As shown in FIG. 5 the horizontal cutting drum (19) is equipped with a number of cutting projections (20) projecting radially outwardly from the drum. The cutting drum (19) as previously mentioned can be raised or lowered to dig further into the snow base if necessary. Generally when the snow is wet or the ice on the ski slope surface is thick the horizontal cutting drum (19) is raised to avoid excessive strain on the machine.

The hydraulic motor (16) rotates the cutting drum via a gear or chain drive found within housing (21). Cutting drum (19) is partially surrounded by rigid housing cover (22) to prevent accidental damage and to retain the snow which is being worked. Projecting from the front top of rigid housing cover (22) is a flexible snow shield (not shown for purposes of clarity). Its remote edge lies adjacent the bottom of snow shields (7) and (8). Attached to the rear portion of rigid housing cover (22) is a flexible membrane which extends downwardly and which can be varied in its geometry to form a smaller or larger snow accumulation chamber. It is this flexible membrane which forms part of the subject matter of the present invention.

At the trailing edge of a flexible membrane (24) is a finisher membrane (25). Membranes (24) and (25) are integrally constructed. On the bottom surface of the finisher membrane (25) are a plurality of grooved corduroy ground finisher elements (27). These are attached to the finisher membrane (25) by means of plates (28).

These corduroy ground finishers are known in the art and are used to produce a smooth corduroy finish to the ski hill.

Figure 7:
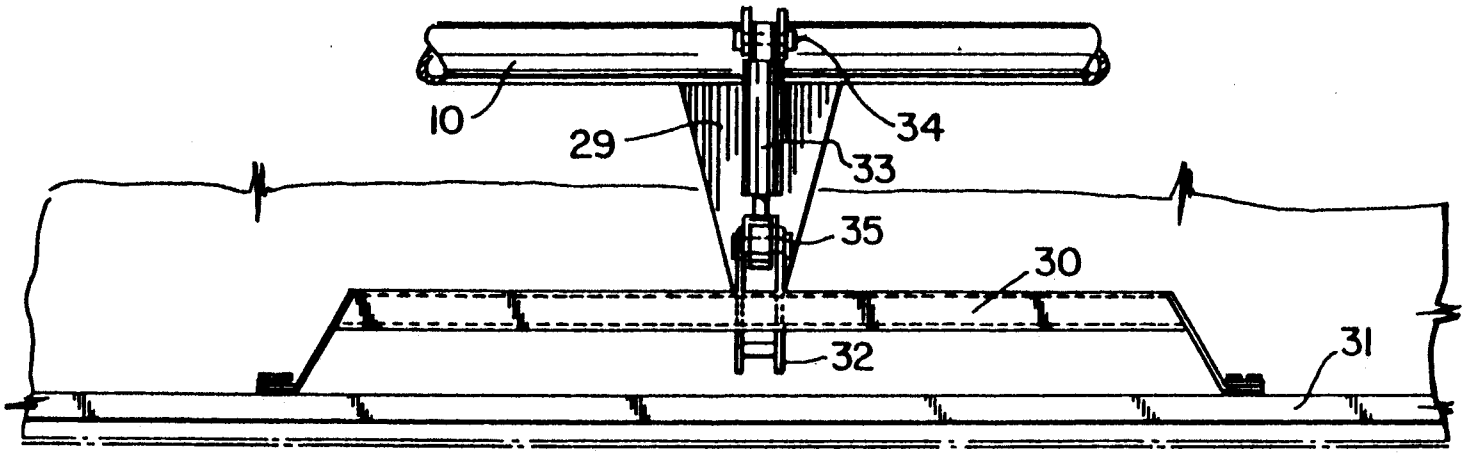
FIG. 7 is an enlarged view of the variable chamber movement means.
Figure 8:
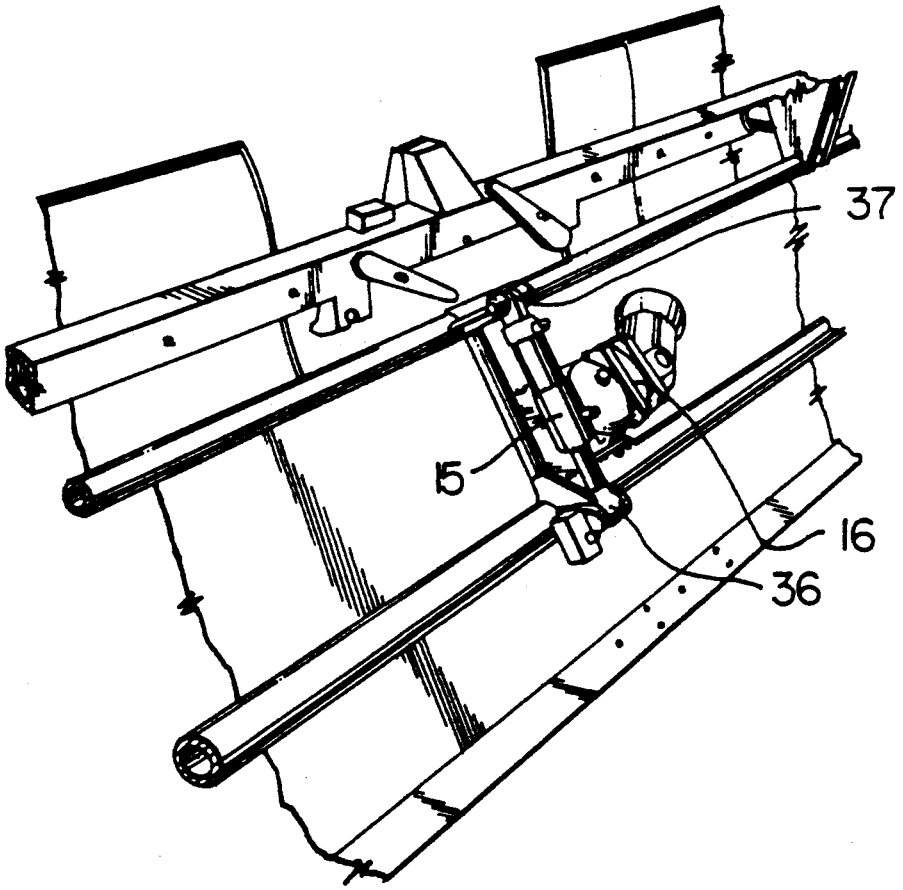
FIG. 8 is an enlarged view of the cutting drum raising and lower means.

As shown more clearly in FIGS. 7 and 8, projecting downwards from the horizontal main structural beam (10) are a pair of support brackets (29) which support the semi-rigid trailing bar support beams (30).

FIG. 8 is an enlarged view of the hydraulic cylinder and piston (15) which is used to displace the horizontal main structural beam (10) and thus raise or lower the horizontal cutting drum (19).

In operation the power source (2) drives forwardly trailing the snow tiller (1). The hydraulic motor (16) is activated thus rotating the cutting drum (19). If there is very little snow on the ground or the slope surface is covered with a sheet of ice the operator can retract the central piston (15) and thus lower the cutting drum (19) such that it can till further into the snow. The retraction of the piston of hydraulic cylinder (15) will decrease the angle (43) between structural support members (11) and (12) and stop brackets (41) thus lowering the horizontal cutting drum (19) in relation to the upper main frame (6).

In wet or heavy snow the converse can occur by extending central piston (15) and increasing the angle (43) thereby raising the horizontal cutting drum (19) upwardly towards main frame (6).

Figure 3:
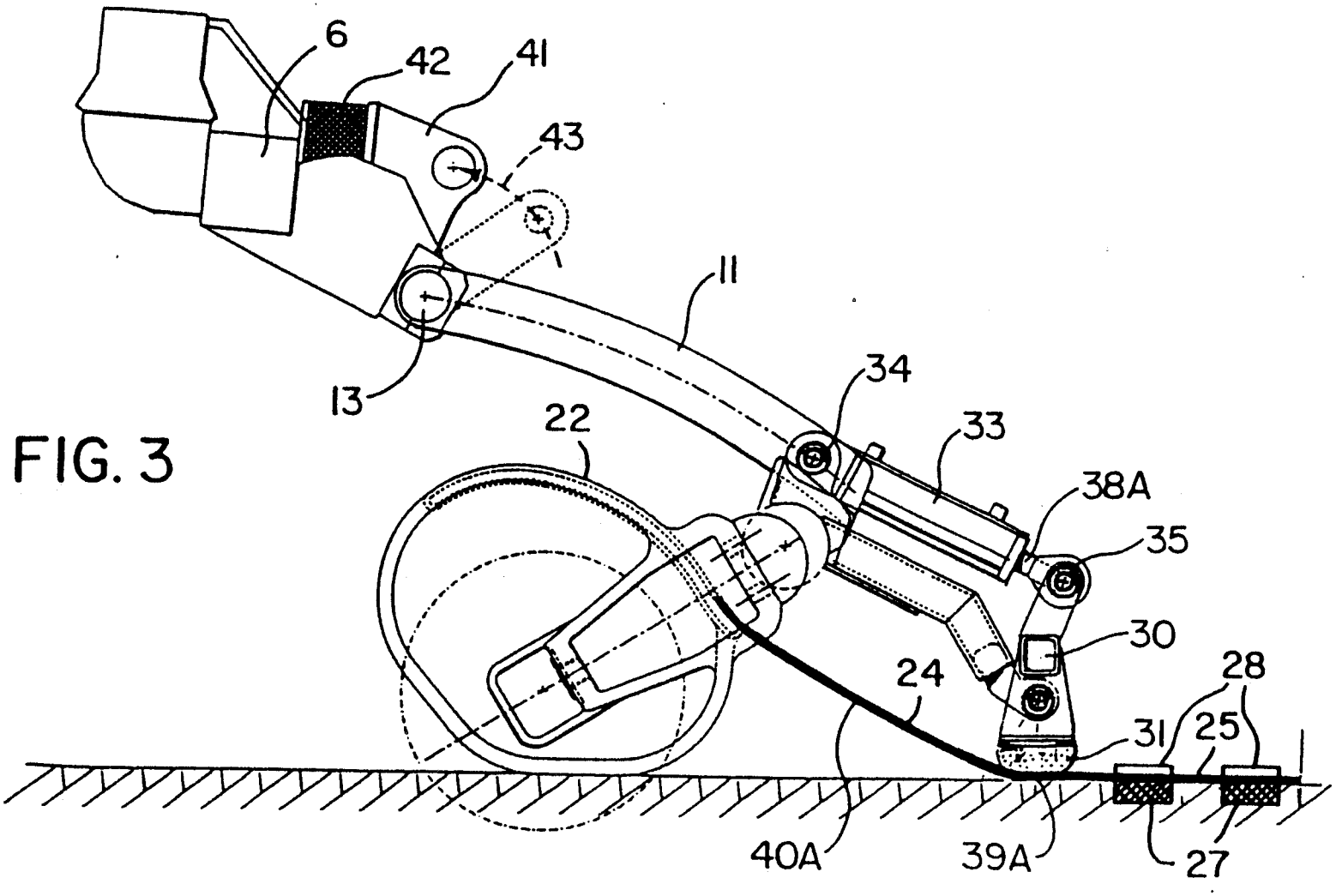
FIG. 3 is a cross-section of the invention under normal snow conditions.

As shown in FIG. 3 under soft snow conditions semi-rigid trailing member (31) is basically flat on the surface of the snow. The top of the snow chamber shown at (40*a*) is a straight line between the rear of the housing cover (22) down to the finishing membrane (25). Clearly in this position the snow is allowed to easily move through and under the corduroy finishers.

The operator may wish to work the snow for a longer period of time. This is particularly important if the snow is comprised of large chunks of ice. In order to work the snow longer within the snow chamber of the tiller (1), the snow chamber configuration is varied.

Figure 4:
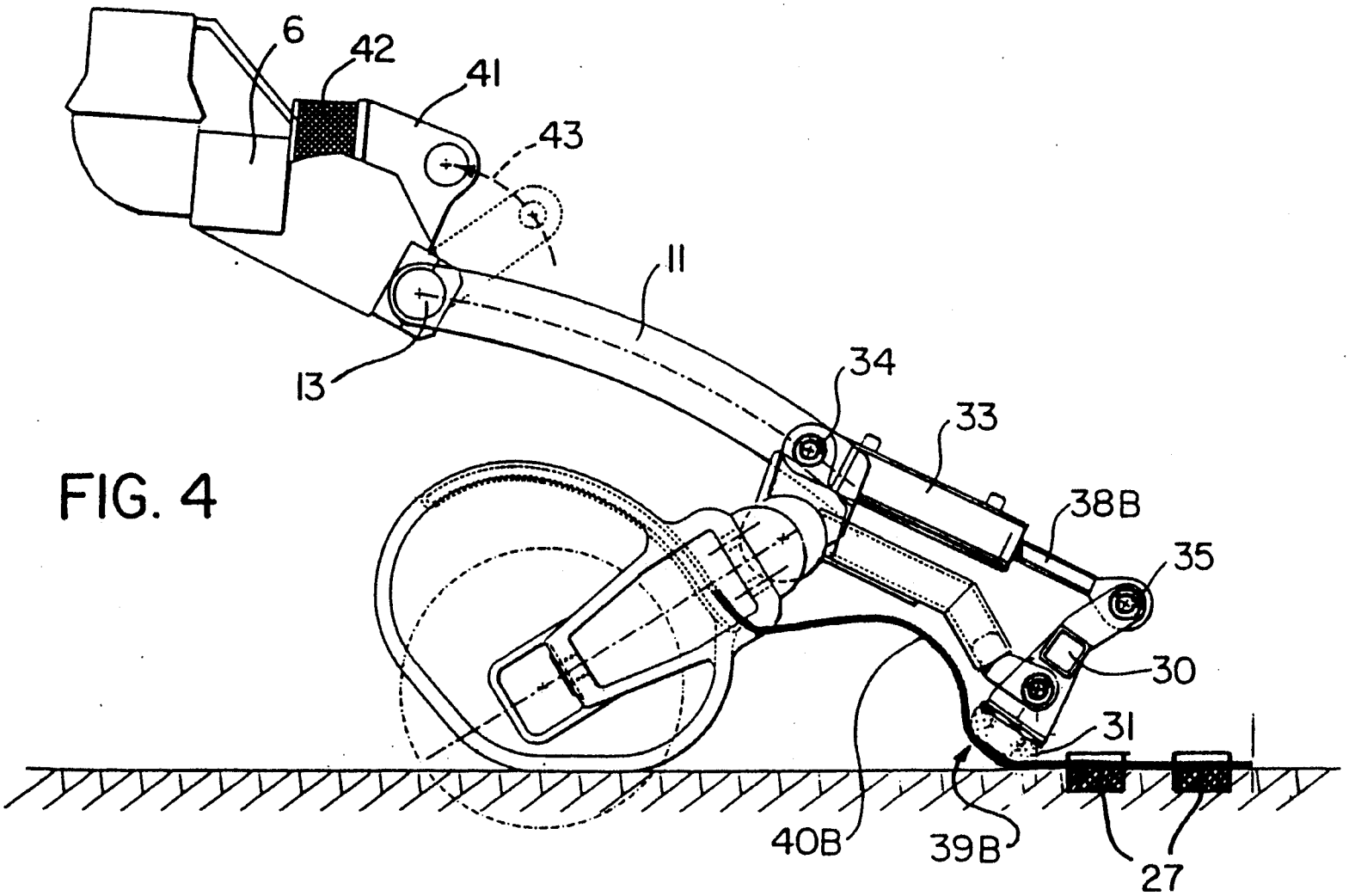
FIG. 4 is a cross-section of the invention operating under harsh snow conditions.

This is accomplished by extending the piston from hydraulic cylinder (33) as shown in FIG. 4 at (38*b*). This causes the semi-rigid trailing bar to tilt upwardly at its front side at a more substantial angle such as shown at (39*b*). At the same time the flexible membrane between cutting drum housing (22) and the trailing bar (31) is contoured upwardly by the greater accumulation of snow thereby enlarging the snow chamber as shown as (40*b*). This permits further working of the snow before the snow passes under the finishing membrane (25) through the corduroy surface finishers (27).

Adjustments can be made easily and quickly for differing snow conditions on the same hill on the same day in different areas. The operator activates all of the controls to move the various cylinders from the security of the cab and needs only to glance in the rear view mirror to discern if the correct quantity and quality of snow is being left behind.

It is to be understood that the essence of the present invention is not confined to the particular embodiment described herein but extends to any device which varies the amount of time that the snow remains in the snow chamber of a tiller.

What I claim is:

1. A snow tiller device adapted to be pulled along a snow surface, comprising:

a horizontally disposed cutting drum;

a snow chamber located to the rear of said cutting drum and extending substantially parallel thereto, said snow chamber being open at its front and bottom and including a flexible membrane by which the top of said snow chamber is bounded; and a varying means for varying the size of said snow chamber depending on snow conditions.

2. A snow tiller device as claimed in claim 1 wherein said varying means is a power means for flexing said flexible membrane such that said snow chamber is varied in size and hence said cutting drum works the snow collected for greater or lesser periods as desired depending upon snow conditions.

3. A snow tiller device as claimed in claim 2 wherein said power means includes a flexible trailing bar at a rearward end of said flexible membrane and at least one hydraulic cylinder and piston means for varying the distance of said trailing bar from said cutting drum and hence flexing said flexible membrane.

4. A snow tiller device as claimed in claim 3 wherein said trailing bar is fixedly secured to an upper side of said flexible membrane and extends substantially across a width of said membrane parallel to said cutting drum such that said trailing bar follows the contour of the terrain.

5. A snow tiller device as claimed in claim 4 and further including a partially covered housing in which said cutting drum is adapted to rotate, said cutting drum and said covered housing having a longitudinal axis which is transverse to a direction of travel of the snow tiller when in operation.

6. A snow tiller device as claimed in claim 5 and further including a flexible trailing membrane extending rearwardly from the rearward end of said flexible membrane.

7. A snow tiller device as claimed in claim 6 wherein said flexible membrane and said trailing membrane are integrally connected.

8. A snow tiller device as claimed in claim 7 wherein said trailing membrane is located rearwardly of said flexible trailing bar, and wherein said trailing membrane includes a plurality of surface finishing elements fixedly mounted to an under side thereof.

9. A snow tiller device as claimed in claim 8 wherein said snow chamber is bounded at a rear thereof by said trailing bar.

10. A snow tiller device as claimed in claim 3 wherein said power means includes a main structural member, a pair of support brackets fixedly mounted to said flexible trailing bar, and two hydraulic cylinder and piston means pivotally mounted between said main structural member and a respective said support bracket.

11. A snow tiller device as claimed in claim 10 wherein said piston and cylinder means move from a retracted position where said trailing bar is most distant from said cutting drum to an extended position where said trailing bar is moved to a position closer to the cutting drum such that the closer position of the trailing bar allows less snow to pass under said flexible membrane which increases the amount of snow built up in said snow chamber which in turn causes said flexible membrane to flex upwardly and increase the size of said snow chamber.

12. A snow tiller device as claimed in claim 10 wherein said piston and cylinder means move from a retracted position wherein said snow chamber is smaller to an extended position where said snow chamber is larger; and wherein said trailing bar includes a planar bottom such that when said piston and cylinder means are in the retracted position said planar bottom lies substantially in a plane of the snow surface.

13. A snow tiller device as claimed in claim 10 wherein said trailing bar is semi-rigid and adapted to flex such that said trailing bar and an underlying portion of said flexible membrane lie adjacent the snow surface throughout a width of said cutting drum and follow any contours and irregularities of the snow surface.

14. A snow tiller device as claimed in claim 5 and further including a hydraulic motor means for rotating said cutting drum and a piston means for raising and lowering said cutting drum relative to the snow surface.

15. A snow tiller device as claimed in claim 5 wherein said flexible membrane is made of a reinforced synthetic rubber mat.

16. A method for grooming a snow surface of a ski slope comprising the steps of:

moving a new tiller in a forward direction over the snow surface;

rotating a cutting drum of the snow tiller in contact with the snow surface;

varying a height of a longitudinal axis of the cutting drum relative to the snow surface; and varying a size of a snow chamber of the tiller behind the cutting drum in order to vary the length of time that snow in the snow chamber is worked by the cutting drum.

* * * * *